United States Patent [19]

Watanabe et al.

[11] Patent Number: 4,487,826

[45] Date of Patent: Dec. 11, 1984

[54] DIAZOTYPE HEAT DEVELOPMENT RECORDING MEDIUM WITH HYDROPHOBIC SALT OF ALKYL SUBSTITUTED GUANIDINE

[75] Inventors: Niro Watanabe; Shiro Nemoto; Hiroyuki Yasujima, all of Tokyo; Kaneki Yoshida, Niiza, all of Japan

[73] Assignee: Toppan Printing Co., Ltd., Tokyo, Japan

[21] Appl. No.: 458,717

[22] Filed: Jan. 17, 1983

[30] Foreign Application Priority Data

Jan. 27, 1982 [JP] Japan ..... 57-11243

[51] Int. Cl.[3] ..... G03C 1/60

[52] U.S. Cl. ..... 430/176; 430/151; 430/178; 430/179; 430/346; 430/541; 430/9; 430/14; 430/141; 430/162; 346/76 PH; 346/135.1

[58] Field of Search ..... 430/151, 179, 177, 176, 430/346, 541, 178

[56] References Cited

U.S. PATENT DOCUMENTS

| | | | |
|---|---|---|---|
| 3,416,924 | 12/1968 | Tummers | 430/151 |
| 3,493,374 | 2/1970 | Roncken et al. | 430/177 |
| 3,642,483 | 2/1972 | Kubo et al. | 430/179 |
| 3,769,013 | 10/1973 | Yokoyama . | |
| 4,387,150 | 6/1983 | Yabuta et al. | 430/151 |
| 4,400,456 | 8/1983 | Matsuda et al. | 430/151 |

FOREIGN PATENT DOCUMENTS

| | | | |
|---|---|---|---|
| 45-8500 | 3/1970 | Japan | 430/151 |
| 51-25727 | 8/1976 | Japan | 430/151 |
| 1128762 | 10/1968 | United Kingdom | 430/151 |

*Primary Examiner*—Charles L. Bowers, Jr.
*Attorney, Agent, or Firm*—Bacon & Thomas

[57] ABSTRACT

A diazotype heat development recording medium of the present invention has excellent shelf life and heat sensitivity. The medium comprises a support and a recording layer which is formed on said support and which comprises a diazo compound, a coupler, an acid stabilizer, a thermal developer, and a polymeric binder. The thermal developer is a salt of an organic or inorganic acid having a primary dissociation constant of $2\times10^{-1}$ to $1\times10^{-4}$ and an alkyl-substituted guanidine represented by the general formula:

(wherein at least one of R1 and R2 is an alkyl group of $C_8$ to $C_{24}$, and the other of R1 and R2 is a hydrogen atom or an alkyl group of $C_1$ or more).

12 Claims, 4 Drawing Figures

DIAZOTYPE HEAT DEVELOPMENT RECORDING MEDIUM WITH HYDROPHOBIC SALT OF ALKYL SUBSTITUTED GUANIDINE

BACKGROUND OF THE INVENTION

The present invention relates to a diazotype heat development recording medium wherein a recorded image may be fixed, that is, a non-image portion will not cause color development again.

Various conventional imaging methods for converting information into a visual image are known. In general, an image is generally formed by causing a physical or chemical change in response to energy such as light, radiation, electrolysis, magnetism, heat, or pressure.

Heat sensitive recording methods are roughly classified into two types; one utilizes a physical change such as melting, sublimation, or volatilization and the other employs a chemical change by heat. However, a recording medium adopting either of these methods records an image using heat. Therefore, even after recording a non-image portion still retains color development capacity upon application of heat. When the recording medium with an image recorded thereon is brought close to a heat source, the non-image portion is developed, thus impairing the recording function of the medium. Improvements in this respect are highly desirable.

A diazotype heat development recording medium as a dry imaging system has recently been receiving a lot of attention as a heat sensitive recording medium, and extensive studies are being made on it.

The diazotype heat development recording media are classified into three types: alkali precursor type, coupler precursor type, and diazo precursor type. These three image forming methods adopt basically the same principle. First, a diazo compound and a coupler cause coupling reaction by heat energy to form an image with an azo dye. Then, the entire surface of the medium is radiated with light energy to cancel the color development capacity of the non-image portion of the medium and to form a permanent image. However, the three methods differ from each other in the method for causing the coupling reaction. More specifically, in a heat development recording medium of the alkali precursor type, a thermal developer (alkali generating agent) causes a physical change such as decomposition, dissociation, or melting by thermal energy to place the recording layer in an alkali atmosphere. A diazo compound and a coupler then cause the coupling reaction to form an image with an azo dye. In a diazotype heat development recording medium of the coupler precursor type, a coupler which may not cause the coupling reaction at normal temperature is activated by thermal energy to cause the coupling reaction with a diazo compound and to form an image with an azo dye. A heat development recording medium of diazo precursor type utilizes structural isomerization of diazosulfonate by light. An anti diazosulfonate which does not cause the coupling reaction by light energy is isomerized into a syn diasosulfonate which causes the coupling reaction with a coupler upon application of thermal energy, thereby allowing formation of an image with an azo dye.

Diazotype heat development recording media of the three types described above are already known and many patents on them have already been granted. For example, diazotype heat development recording media of the alkali precursor type which use various development assistants are known, as per U.S. Pat. No. 2,653,091, and Japanese Patent Publication Nos. 45-8500, 43-10248 and 49-3926.

Diazotype heat development recording media of the coupler precursor type are known as per Japanese Patent Publications Nos. 45-40153, 47-11797, 49-1562, and 50-14522. These recording media use a 2,3-dihydroxy benzoic acid derivative as a coupler which may cause the coupling reaction by thermal energy.

Diazotype heat development recording media of the diazo precursor type and recording methods utilizing the same are known as per U.S. Pat. No. 2,217,189, U.K. Pat. No. 544,702, DE-AS No. 734,302, and Japanese Patent Disclosure No. 56-5790. These diazotype heat development recording media respectively consist of a diazosulfonate compound, a coupler and a polymeric binder.

However, all these diazotype heat development thermal recording media are subject to disadvantages. For example, diazotype heat development recording media of the alkali precursor type have poor storage stability although they have good heat sensitivity. Diazotype heat development recording media of the coupler precursor type and diazo precursor type have poor heat sensitivity although they have good shelf life. Although extensive studies are being made with a view to solving this problem, a diazotype heat development recording medium which has both good heat sensitivity and shelf life has not yet been proposed.

As a result of experiments conducted by the present inventors on the conventional diazotype heat development recording media, it has been found that heat sensitivity depends on the recording material. Thus, the sensitivity of a diazotype heat development recording medium of the coupler precursor type or diazo precursor type is dependent on the heat sensitivity of the coupler and the diazosulfonate. The heat sensitivity of these organic compounds is determined, in turn, by the position and type of the substituting group. However, when a substituting group for improving heat sensitivity is added, only a slight improvement is obtained. The low heat sensitivity of the recording media of these two types is also attributable to the structure of the recording material. For this reason, the recording media of these types are not suitable in practice and were removed from consideration.

A diazotype heat development recording medium of the alkali precursor type has a recording layer which contains as basic recording elements a diazo compound, a coupler, an acid stabilizer, and a thermal developer and which is formed on a support. The recording layer contains a thermal developer for generating a thermal coupling atmosphere and is basically the same as a commercially avaialble dry or wet type diazotype photosensitive paper except for this thermal developer. Therefore, the shelf life and heat sensitivity of the recording medium largely depend upon the characteristics of the thermal developer used; i.e., chemical or physical stability under normal temperature, solubility in water, thermal coupling capacity and the like. For this reason, the thermal developer to be used in the diazotype recording medium must satisfy the following requirements: chemical and physical stability at temperatures below 50° C. for long shelf life, no solubility in water, and ability to immediately generate a coupling atmosphere at a temperature of 100° to 150° C. for good heat sensitivity, and the like.

SUMMARY OF THE INVENTION

In order to obtain a thermal developer to satisfy the above requirements which determine the characteristics of a diazotype heat development recording medium of the alkali precursor type, the present inventors prepared various substances and examined the heat sensitivity and shelf life of the diazotype heat development recording media containing these substances as thermal developers. On the basis of such studies, it has been found that a diazotype heat development recording medium which contains a salt of a certain type of guanidine compound as a thermal developer has excellent shelf life and heat sensitivity. The present invention is established based on this finding.

The present invention provides a diazotype heat development recording medium comprising a support and a recording layer formed on the support and containing a diazo compound, a coupler, an acid stabilizer, a thermal developer and a polymeric binder, wherein the thermal developer is a salt of an organic or inorganic acid having a primary dissociation constant of $2\times10^{-1}$ to $1\times10^{-4}$ and an alkyl substituted guanidine having the general formula:

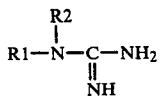

(wherein at least one of R1 and R2 is an alkyl group of $C_8$ to $C_{24}$, and the other of R1 and R2 is a hydrogen atom or an alkyl group of $C_1$ or more).

DETAILED DESCRIPTION OF THE PREFERRED EMBODIMENTS

Figure 1:
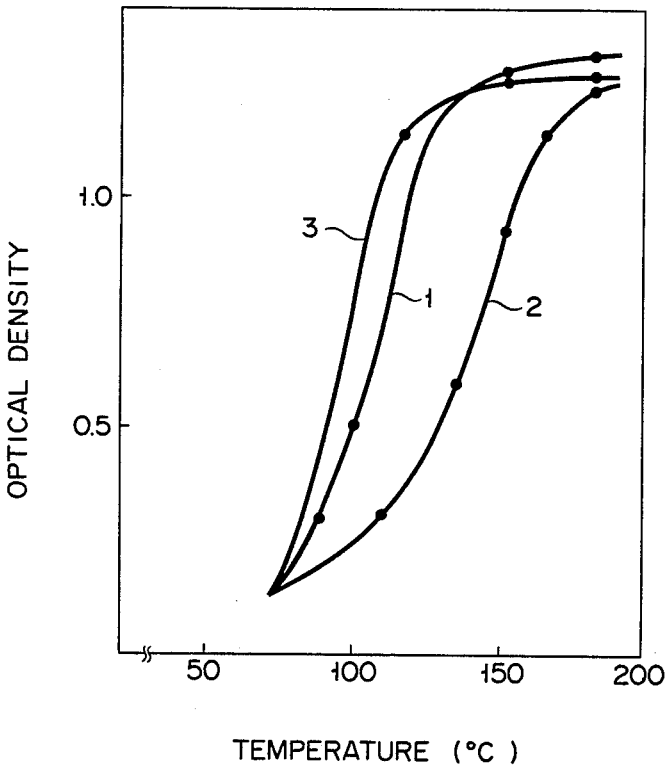
FIG. 1 is a graph showing heat sensitivity curves of media of the present invention and of Comparative Examples.

A diazotype heat development recording medium of the present invention is of the alkali precursor type and uses as a thermal developer a salt selected from the alkyl-substituted guanidine salt. The diazotype heat development recording medium using such a thermal developer has far superior shelf life to that of conventional media and at the same time has a heat sensitivity equivalent to that of a heat sensitive recording medium consisting of a leuco dye. Furthermore, the diazotype heat development recording medium of the present invention can form an image of an azo dye having an optical density of 1.0 or higher.

The thermal developer to be used herein is a salt of an organic or inorganic acid having a primary dissociation constant of $2\times10^{-1}$ to $1\times10^{-4}$ and an alkyl-substituted guanidine having the general formula:

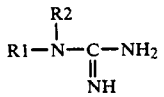

(wherein at least one of R1 and R2 is an alkyl group of $C_8$ to $C_{24}$, and the other one thereof is a hydrogen atom or an alkyl group of $C_1$ or more). Such an alkyl-substituted guanidine is only slightly soluble in water; several milligram or less of it are dissolved in 100 ml of water. Thus, the guanidine compounds are more hydrophobic than hydrophilic. As an acid to form a suitable salt with such a hydrophobic alkyl-substituted guanidine, an organic or inorganic acid having a primary dissociation constant of $2\times10^{-1}$ to $1\times10^{-4}$ may be selected.

Examples of the alkyl-substituted guanidine may include octyl guanidine, nonyl guanidine, decyl guanidine, undecyl guanidine, lauryl guanidine, tridecyl guanidine, myristyl guanidine, hexadecyl guanidine, octadecyl guanidine, eicosyl guanidine, docosyl guanidine, dioctyl guanidine, dioctadecyl guanidine, N-methyl-N-octadecyl guanidine, N-methyl-N-decyl guanidine, and N,N-didecyl guanidine.

An organic or inorganic acid having a primary dissociation constant of $2\times10^{-1}$ to $1\times10^{-4}$ to form a salt with such an alkyl substituted guanidine may be benzenesulfonic acid, trichloroacetic acid, oxalic acid, glycerophosphoric acid, maleic acid, phosphoric acid, citric acid, malonic acid, tartaric acid, malic acid, lactic acid or the like. When an acid having a primary dissociation constant falling within the range mentioned above is used, the salt of the alkyl-substituted guanidine may be rendered neutral or weakly acidic, and may be chemically and physically stable at normal temperature.

The salt of the alkyl-substituted guanidine of the present invention may be prepared by a known method. A solution of the alkyl-substituted guanidine in a suitable solvent is heated to 50° C. and is stirred. A stoichiometric solution of the acid is prepared separately is added dropwise. After dropping, the solution is stirred for about 10 minutes to prepare the salt at a yield of about 100%. All the salts of the alkyl-substituted guanidine which may be used in the present invention may be prepared by this method. A diazotype heat development recording medium containing as a thermal developer a salt of such an alkyl-substituted guanidine has excellent shelf life as well as excellent heat sensitivity.

For the purpose of comparison, FIG. 1 shows heat sensitivity curves as a function of temperature of the media of the present invention and of the prior art when the pressure is 2 kg/cm$^2$ and the heating time is 5 seconds.

Curve 1 represents the results obtained with a diazotype heat development recording paper of the present invention which uses an oxalate of octadecyl guanidine as a thermal developer. Curve 2 represents a commercially available diazotype heat development recording paper which uses as a thermal developer an oxalate of octadecyl amine. Curve 3 represents a commercially available heat sensitive recording paper sheet consisting of a leuco dye.

The diazotype heat development medium of the present invention has such excellent properties because the salt of the alkyl-substituted guanidine has the following characteristics:

(1) The alkyl substituted guanidine is more hydrophobic than hydrophilic.

(2) The salt of the alkyl-substituted guanidine is only slightly soluble in water and is neutral or weakly acidic.

(3) The salt of the alkyl-substituted guanidine is stable at normal temperature and is capable of immediately forming a coupling atmosphere at a temperature of about 100° C.

Owing to these characteristics, the diazotype heat development recording medium of the present invention has a satisfactory shelf life which has until now been very difficult to attain. At the same time, the recording medium of the present invention has a heat sensitivity equivalent to that of the heat sensitive recording medium consisting of a leuco dye, and can form an image of an azo dye of an optical density of 1.0 or more.

The component of the recording medium of the present invention other than the thermal developer will now be described.

Various types of diazo compounds may be used herein. Examples of the diazo compound may include 4-diazo-N,N-dimethylaniline, 4-diazo-N,N-diethylaniline, 4-diazo-N-ethyl-N-2'-hydroxyethylaniline, 4-diazo-3-ethoxy-N,N-diethylaniline, 4-diazo-2-chloro-N,N-diethylaniline, 4-diazo-N-methyl-N-cyclohexylaniline, 4-diazo-N-ethyl-N-benzylaniline, 4-diazo-5-chloro-2-(4'-chloro phenoxy)-N,N-dimethylaniline, 4-diazo-5-chloro-2-ethoxy-N-methyl-N-benzylaniline, 4-diazo-N-phenylmorpholine, 4-diazo-2,5-diethoxy-N-ethyl-N-benzylaniline, 4-diazo-2,5-diethoxy-N-phenylmorpholine, 4-diazo-2,5-di-n-butoxy-N-phenylmorpholine, 4-diazo-2,5-dimethoxy-N-phenylpyrrolidone, 4-diazo-2,5-dimethoxy-N-phenylpiperidine, N-4-diazo-2,5-dipropoxyphenyl-N'-methylpiperidine, 4-diazodiphenylamine, 4-diazo-2-methoxy-N-methylaniline, 2-diazo-4-methylmercapto-N,N-dimethylaniline, 2-diazo-5-benzoylamino-N,N-dimethylaniline, and 2-diazo-1-naphthol-5-sulfonic acid. The diazo compound as described above is used in a relatively stable form such as a sulfate or hydrochloride. Alternatively, the diazonium compound may be used in the form of a double salt of zinc chloride, cadmium chloride, stannic chloride or fluoroboric acid. Also, a diazonium sulfonate may be used.

The coupler to be used herein may be one which is conventionally used in photo sensitive diazotype paper, examples of which may include 1,3-dihydroxybenzene, 1,3,5-trihydroxybenzene, 1-hydroxynaphthalene-6-sulfonic acid Na salt, 2,3-dihydroxynaphthalene-6-sulfonic acid Na salt, 2-hydroxynaphthalene-3,6-disulfonic acid Na salt, 1-hydroxynaphthalene-4-sulfonic acid Na salt, 2,3-dihydroxynaphthalene, 2,3-dihydroxy-1-naphthoic acid, 1,4-dichloro-2,3-dihydroxynaphthalene, 2-hydroxy-3-naphthoic acid, 2-hydroxynaphthalene-3-carbonylmorpholinopropylamide, 2-hydroxy-6-naphthoic-acid, 2-hydroxynaphthalene-6-carbonyldimethylaminopropylamide, 2,6-dihydroxybenzoic acid, 2,2'-4,4'-tetrahydroxy diphenyl sulfide, and acetoacetanilide.

To improve shelf life under conditions of high humidity, a hydrophobic diazo compound and a hydrophobic coupler which are soluble in an organic solvent should be preferably used instead of the diazo compound and the coupling agent which are generally used in photo sensitive diazotype paper. Under conditions of high humidity, a combination of a hydrophilic diazo compound and a hydrophilic coupler will absorb water in the air to cause disolution of the diazo compound and the coupler in the recording layer. Then, an azo dye is produced by pre-coupling reaction to impair shelf life of the recording medium. In order to suppress pre-coupling reaction due to the presence of moisture in the air, a combination of a hydrophobic diazo complex such as diazonium tetrafluoroborate, with a hydrophobic coupler (soluble in an organic solvent) such as an aromatic hydroxy compound having a sulfamoyl group, a carbamoyl group or a carboxyl group in the molcule is preferably used. Examples of an aromatic hydroxy compound having a sulfamoyl group in the molecule as the hydrophobic coupler may include 2,3-dihydroxynaphthalene-6-sulfamoyl, 2-hydroxynaphthalene-3,6-disulfamoyl, 2,8-dihydroxynaphthalene-6-sulfamoyl, 1,8-dihydroxynaphthalene-2-sulfamoyl, 1-amino-8-hydroxynaphthalene-5-sulfamoyl, 2,7-dihydroxynaphthalene-3,6-disulfamoyl, 1-benzoylamino-8-hydroxynaphthalene-2-sulfamoyl, 1,8-dihydroxynaphthalene-6-sulfamoyl, 2-acetoacetaminonaphthalene-7-sulfamoyl, 2-acetoacetaminonaphthalene-6-sulfamoyl, 2-acetoacetaminonaphthalene-8-sulfamoyl, 1-acetoacetaminonaphthalene-4-sulfamoyl, and 1-acetoacetaminonaphthalene-5-sulfamoyl; and sulfamoyl derivatives thereof.

Examples of an aromatic hydroxy compound having a carbamoyl group in the molecule may include 2-hydroxynaphthalene-3-carbonyl propylamide, 6-bromo-2-hydroxynaphthalene-3-carbonyl propylamide, 1-hydroxynaphthalene-2-carbonyl propylamide, 2-hydroxynaphthalene-3-carbonyl-4'-methoxyanilide, 2-hydroxynaphthalene-3-carbonyl-3'-nitroanilide, 2-hydroxynaphthalene-3-carbonyl-4'-chloroanilide, 2-hydroxynaphthalene-3-carbonyl-2'-methylanilide, 2-hydroxynaphthalene-3-carbonyl-2'-methoxyanilide, 2-hydroxynaphthalene-3-carbonyl-2'-ethoxyanilide, 2-hydroxynaphthalene-3-carbonyl-2',5'-dimethoxyanilide, 2-hydroxynaphthalene-3-carbonyl-2'-methoxy-5'-nitroanilide, 2-hydroxynaphthalene-3-carbonyl-2'-methyl-5'-chloroanilide, 2-hydroxynaphthalene-3-carbonyl-2'-methyl-4'-chloroanilide, 2-hydroxynaphthalene-3-carbonyl-5'-chloro-2',4'-dimethoxyanilide, 2-hydroxynaphthalene-3-carbonyl-4'-chloro-2',5'-dimethoxyanilide, 2-hydroxynaphthalene-3-carbonyl-2'-methoxy-5'-chloroanilide, 1-hydroxynaphthalene-2-carbonyl-4'-methoxyanilide, 1-hydroxynaphthalene-2-carbonyl-3'-nitroanilide, 1-hydroxynaphthalene-2-carbonyl-4'-chloroanilide, 1-hydroxynaphthalene-2-carbonyl-2'-methylanilide, 2-hydroxynaphthalene-2-carbonyl-2'-ethoxyanilide, 1-hydroxynaphthalene-2-carbonyl-2'-methoxyanilide, 1-hydroxynaphthalene-2-carbonyl-2'-methoxy-5'-nitroanilide, 1-hydroxynaphthalene-2-carbonyl-2'-methyl-4'-chloroanilide, 1-hydroxynaphthalene-2-carbonyl-2'-methoxy-4'-chloroanilide, 1-hydroxynaphthalene-2-carbonyl-3'-6'-dimethoxy-4'-chloroanilide, and 1-hydroxynaphthalene-2-carbonyl-3'-chloro-4',6'-dimethoxyanilide.

Examples of an aromatic hydroxy compound having a carboxyl group in the molecule may include 2-hydroxynaphthalene-3-carbonylphenyl ester, 2-hydroxynaphthalene-3-carbonyl-4'-methoxyphenyl ester, 2-hydroxynaphthalene-3-carbonyl-3'-nitrophenyl ester, 2-hydroxynaphthalene-3-carbonyl-4'-chlorophenyl ester, 2-hydroxynaphthalene-3-carbonyl-2'-methylphenyl ester, 2-hydroxynaphthalene-3-carbonyl-2'-ethoxyphenyl ester, 2-hydroxynaphthalene-3-carbonyl-2'-methoxyphenyl ester, 2-hydroxynaphthalene-3-carbonyl-2'-methyl-4'-chlorophenyl ester, 2-hydroxynaphthalene-3-carbonyl-2'-methoxy-5'-nitrophenyl ester, 2-hydroxynaphthalene-3-carbonyl-2'-methyl-5'-chlorophenyl ester, 2-hydroxynaphthalene-3-carbonyl-2'-methoxy-5'-chlorophenyl ester, 2-hydroxynaphthalene-3-carbonyl-3',6'-dimethoxy-4-chlorophenyl ester, 2-hydroxynaphthalene-3-carbonyl-3'-chloro-4',6'-dimethoxyphenyl ester, 1-hydroxynaphthalene-2-carbonyl-phenyl ester, 1-hydroxynaphthalene-2-carbonyl-4'-methoxyphenyl ester, 1-hydroxynaphthalene-2-carbonyl-3'-nitrophenyl ester, 1-hydroxynaphthalene-2-carbonyl-4'-chlorophenyl ester, 1-hydroxynaphthalene-2-carbonyl-2'-methylphenyl ester, 1-hydroxynaphthalene-2-carbonyl-2'-ethoxyphenyl ester, 1-hydroxynaphthalene-2-carbonyl-2'-methoxyphenyl ester, 1-hydroxynaphthalene-2-carbonyl-2'-methyl-4'-chlorophenyl ester, 1-hydroxynaphthalene-2-carbonyl-2'-methoxy-5'-nitrophenyl ester, 1-hydroxynaphthalene-2-carbonyl-2'-methyl-5'-chlorophenyl ester, 1-hydroxynaphthalene-2-carbonyl-2'-methoxy-5'-chlorophenyl ester, 1-hydroxynaphthalene-2-carbonyl-3',6'-dimethoxy-4-chlorophenyl ester, and 1-hydroxynaphthalene-2-carbonyl-3'-chloro-4',6'-dimethoxyphenyl ester.

In order to prepare a black imaging diazotype heat development recording medium, the present inventors conducted studies on various combinations of couplers of different hues which are conventionally used in photosensitive diazotype recording paper. For example, a black-type recording medium was obtained by combining a compound having an active methylene group such as an acetoamide derivative as a yellow coupler with a β-naphthol derivative as a blue coupler. However, a compound having an active methylene group is faster in coupling speed than the β-naphthol derivative. For this reason, when a recording medium which has acceptable shelf life and heat sensitivity is prepared using the compound having an active methylene group as a standard, the dye image has a different hue in accordance with changes in the developing conditions such as thermal energy. Depending upon particular developing conditions, a black image may not be formed.

Based on these studies, the present inventors have found a black-type diazotype heat development recording medium which will not cause a change in hue due to changes in thermal energy and which is obtained by a novel combination of couplers of different colors. Such a recording medium is prepared from a combination of a blue coupler which is a compound having the general formula (I) below:

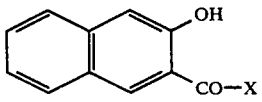

(wherein X is —OAr or —NH—Ar, and Ar is a phenyl derivative), with a yellow coupler which is a compound having the general formula (II) below:

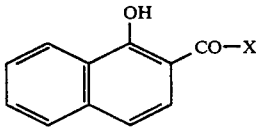

(wherein X is —O'Ar or —NH—Ar', and Ar' is a phenyl derivative). Since the coupling speeds of the blue and yellow couplers as the coupling component are almost the same, the medium of the present invention develops black images under any developing conditions.

The acid stabilizer to be used herein may be a known non-volatile acid which is conventionally used in a diazo substance, such as citric acid, gluconic acid, oxalic acid, tartaric acid, sulfamic acid, hydroxyamine hydrochloric acid, boric acid, or phosphoric acid. Shelf life and heat sensitivity of the medium of the present invention may not be impaired with the addition of an antioxidant for improving storage stability after recording. The antioxidant may be thiourea, L-ascorbic acid, urea, or aryl isothiocyanate.

A polymeric binder is used in the medium of the present invention for the purpose of improving adhesion strength between the recording layer and the support, coating uniformity of the recording layer, resistance to water, and the like. Depending upon the application of the medium, omission of a polymeric binder may not particularly impair the characteristics of the medium. Examples of the polymeric binder include polyvinyl alcohol, hydroxyethyl cellulose, polyvinyl alcohol-gum arabi, polyvinyl acetate emulsion, methyl cellulose, ethyl cellulose, polyvinyl acetate, nitro cellulose, polystyrene, polymethylstyrene, polyphenylstyrene, polychlorostyrene, polyxylene, polyvinylbutyral, cellulose acetate-butyrate copolymer, polyethylene terephthalate, triacetyl cellulose, polyacrylate, polyacrylonitrile, polymethyl methacrylate, polymethyl/butyl acrylate, polyisobutyl methacrylate, polybutyl methacrylate, polychloromethyl acrylate, polyvinyl-tert.-butyl ether, polyvinyl chloride and vinyl acetate copolymer.

Thermoplastic resins, such as polysyrene, polymethylstyrene, polyphenylstyrene, polychlorostyrene, polyxylene, polyvinylbutyral, cellulose acetate-butyrate copolymer, polyethylene terephthalate, triacetyl cellulose, polyacrylate, polyacrylonitrile, polymethyl methacrylate, polymethyl/butyl acrylate, polyisobutyl methacrylate, polybutyl methacrylate, polychloromethyl acrylate, polyvinyl-tert.-butyl ether, polyvinyl chloride and vinyl acetate copolymer, which have glass transition points of 60° to 130° C. are particularly preferable as the polymeric binder for the following reasons. When a thermoplastic resin having a glass transition point lower than 60° C. is used as a polymeric binder, the resultant diazotype heat development recording medium may cause blocking during storage. On the other hand, if a thermoplastic resin having a glass transition point higher than 130° C. is used as a polymeric binder, the molecular movement of the resultant medium is insufficient so that heat sensitivity may be degraded.

When a thermoplastic resin having a glass transition point of about 100° C. is used as a polymeric binder of the recording layer, it may cause deposition or sticking of the medium on the thermal head during thermal printing with a thermal printer. The thermal developer used in the present invention prevents such a problem. The salt of an alkyl-substituted guanidine used as a thermal developer in the medium of the present invention has a straight chain alkyl group in the molecule and thus serves as a lubricant.

The medium of the present invention may be coated on the support by a known method. First, a recording material consisting of a diazo compound, a coupler, an acid stabilizer, a polymeric stabilizer, and an antioxidant (added as needed) is dissolved in water or an organic solvent. The resultant solution is mixed with a dispersion containing a thermal developer to prepare a homogeneous coating solution. The coating solution is applied on a support such as a paper sheet, a glass plate, or a plastic film or sheet using a wire bar, an air knife coater, a roll coater, or a gravure coater. The coated layer is dried at a temperature lower than 80° C. to prepare a diazotype heat development recording medium. A diazotype heat development recording medium of bilayered structure may be prepared in the following manner. A mixture of a thermal developer, a coupler, a polymeric binder and an antioxidant (as needed) is uniformly dispersed in water or an organic solvent to prepare a homogeneous coating solution. The coating solution is coated on a support by one of the means mentioned above. After drying this first coated layer, a sensitizing solution obtained by dissolving a recording material consisting of a diazo compound, an acid stabilizer, and a polymeric binder in water or an organic solvent is coated thereover with a similar coating means. The second coated layer is dried at a low temperature. The coating order of the first and second coated layers may be reversed.

If a thermal developer which is soluble in an organic solvent is used, a solution may be used in place of the dispersion. This will not adversely affect the characteristics of the medium of the present invention.

Recording with a diazotype heat development recording medium may be performed by two methods. According to the first method, an image is formed by thermal energy, and the entire medium is irradiated with light energy to fix the image. Thus, a permanent image is formed by heat and light energy. According to the second method, an electrostatic latent image is formed by light energy, and the entire medium is radiated with heat energy to develop the image. Thus, a permanent image is similarly formed by heat and light energy. Since the image is formed thermally in the first method, resolution of the recorded image is slightly degraded and gradation depends on the recording mechanism. On the other hand, since the image is formed optically, excellent resolution and gradation are obtained with the second method.

Recording with a diazotype heat development recording medium of the present invention is performed in the positive-positive mode. The image can be formed by either of the two methods described above. Recording of an image such as a photograph may be conveniently performed by the optical image formation method which results in excellent resolution and gradation. However, a character or pattern image may be conveniently recorded by the thermal image recording method which provides excellent recording characteristics of such an image despite slightly degraded resolution and gradation. A thermal energy source may be a thermal head, a thermal pen, infrared light, a laser beam, a heated roller or the like. A light energy source may be a mercury lamp, a xenon lamp, a tungsten lamp, a xenon flash device, a laser or the like.

The medium of the present invention has the structure and features as described above and can thus provide the following advantages:

(1) The salt of an alkyl substituted guanidine as a thermal developer is hydrophobic, is stable at normal temperature, and immediately generates a coupling atmosphere at temperatures of about 100° C.

(2) Since the diazonium compound, the coupler and the thermal developer are hydrophobic compounds, precoupling during storage due to humidity in the air is prevented.

(3) Since a polymeric binder is used, water resistance, chemical resistance and wear resistance of the resultant medium after fixing an image thereon are excellent.

(4) The salt of an alkyl substituted guanidine as a thermal developer also serves as a lubricant since it has a straight chain alkyl group in the molecule. Therefore, deposition or sticking of the medium on the thermal head of a thermal printer is prevented.

(5) The image formation process is a dry imaging system using thermal and light energy.

A diazotype heat development recording medium of the present invention has satisfactory shelf life as well as good heat sensitivity and chemical resistance which have heretofore been simultaneously unattainable. Furthermore, since the image formation process is a dry imaging system using both thermal and light energy, the medium provides a wide variety of applications. The medium of the present invention can, for example, be applied to coupons, cards, commuter's passes, and the like which must be protected against forgery, or as a recording medium of an output printer of a computer or as terminal equipment for data communication.

The present invention will now be described by way of its examples. Parts in each Example to be described below all indicate parts by weight unless otherwise indicated.

EXAMPLE 1

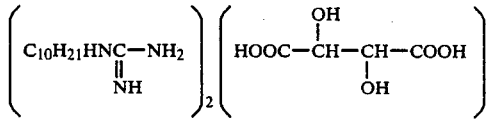

A coating solution consisting of 3 parts of di-(n-decyl guanidine) tartarate of the above general formula and 100 parts of ethanol was coated on a paper sheet with a #20 wire bar. The coated layer was then dried. Another coating solution consisting of 1 part of p-N,N-diethylaminobenzene diazonium zinc chloride, 2 parts of 2,3-dihydroxynaphthalene-6-sulfonic acid Na salt, 0.8 part of tartaric acid, and 100 parts of a water/ethanol solution (9:1) was coated thereover with a #18 wire bar. The coated layer was dried at a low temperature to prepare a diazotype heat development recording medium. The recording medium was tested by printing with a thermal head (manufactured by Toshiba Corporation) at a voltage of 1.2 V and a pulse width of 2.75 ms. The entire recording medium was then exposed with a mercury lamp. A blueish purple image having an optical density of 1.2 was obtained with a pale background.

For the purpose of comparison, diazotype heat development recording media of Comparative Examples 1 and 2 were prepared by the same procedures except that di-(decyl ammonium) tartarate and phenyl guanidine tartarate were used in place of di-(decyl guanidine) tartarate as the thermal developer. The resultant recording media were examined for their heat sensitivity and shelf life.

| | Density immediately after preparation | | After 40° C. at 20% RH for 5 days | |
|---|---|---|---|---|
| | Image portion | Non-image portion | Image portion | Non-image portion |
| Example 1 | 1.3 | 0.12 | 1.3 | 0.13 |
| Comparative Example 1 [Di-(decyl ammonium) tartarate] | 0.7 | 0.11 | 0.8 | 0.60 |
| Comparative Example 2 (Phenyl guanidine tartarate) | 0.7 | 0.13 | 0.7 | 0.65 |

Each recording paper was subjected to recording with a thermal gradient tester (heating conditions: 130° C. temperature, 2 kg/cm$^2$ pressure, and 5 second heating time). Thereafter, each recording paper was entirely irradiated with light from a mercury lamp and the image was fixed. The optical density was thus obtained.

As may be seen fron the above result, satisfactory heat sensitivity and shelf life were not obtained in the Comparative Examples.

EXAMPLE 2

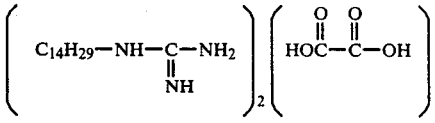

A mixture of 5 parts of myristyl guanidine oxalate of the above general formula, 5 parts of poly-p-chlorostyrene (130° C. glass transition point), 70 parts of methyl ethyl ketone, and 30 parts of toluene, was uniformly dispersed with a disperser to prepare a coating solution. The coating solution was coated on a polyester film with a roller coater and the coated layer was dried. A sensitizing solution was prepared which consisted of 0.4 part of citric acid, 0.2 part of thiourea, 0.2 part of p-toluene sulfonic acid, 2 parts of 2,3-dihydroxynaphthalene-6-sulfamoyl, 1 part of 4-morpholinobenzene diazonium tetrafluoroborate, and 3 parts of poly-p-chlorostyrene. The sensitizing solution was coated with a roller coater and the coated layer was dried at 60° C. to prepare a diazotype heat development recording film.

The recording film was tested with a thermal printer (manufactured by Toshiba Corporation) at a printing power of 0.45 W and a pulse width of 2.75 ms. The entire film was then irradiated with light from a mercury lamp. The obtained image was a blueish purple image having an optical density of 1.2 with a pale background. The same films were stored before exposure at 30° C. and 20% RH for 3 months and at 30° C. and 90% RH for 1 month, and were then entirely exposed with light from a mercury lamp. The films were examined for discoloration, color deterioration, and fogging of the non-image portion. No discoloration of the image-portion and fogging of the base occurred under the above conditions. When the image portion was rubbed after fixing with gauze dampened with water or methyl alcohol, the image did not cause discoloration or color deterioration. The recording medium of Example 2 had characteristics which could withstand actual application.

EXAMPLE 3

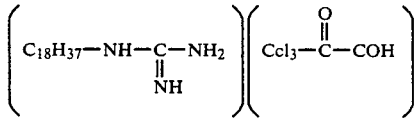

A dispersion consisting of 2 parts of silica powder, 4 parts of polyurethane resin, 8 parts of methyl ethyl ketone, and 2 parts of toluene was kneaded for 24 hours with a ball mill to prepare a coating solution. The coating solution was coated on a polyester film (200$\mu$ thickness) with a roller coater. The coated layer was dried to form a porous silica layer. Another dispersion was prepared with a disperser which consisted of 6 parts of octadecyl guanidine trichloroacetate of the above general formula, 8 parts of polymethyl methacrylate (60° C. glass transition point), 70 parts of methyl ethyl ketone, 30 parts of toluene. A mixture of 0.8 part of oxalic acid, 2 parts of 2-hydroxy-3-carbonylphenylanilide, and 1 part of 4-morpholino-2,5-dibutoxybenzene diazonium tetrafluoroborate was added to the dispersion solution to prepare a sensitizing solution. The sensitizing solution was coated with a roller coater and the coated layer was dried with an air heater at 60° C. to prepare a diazotype heat development recording medium.

The recording medium thus obtained was tested with a thermal printer (manufactured by Toshiba Corporation) at a printing power of 0.45 W and a pulse width of 2 ms. The entire medium was then exposed with light from a xenon flash device (450 J exposure energy). A blue image having an optical density of 1.2 was formed with a pale background. The same media were stored before exposure at 30° C. and 20% RH for 4 months and at 30° C. and 90% RH for 1 month, and were then entirely exposed with light from a xenon flash device. The media were examined for their discoloration, color deterioration, and fogging of the base. No discoloration, color deterioration or fogging of the base was observed under the conditions given above. After an image was fixed, the medium was rubbed with gauze dampened with water, a solution of neutral detergent, naphtha, alcohol, and the like. The image did not cause any discoloration or color deterioration.

The recording medium of Example 3 also had characteristics which can withstand actual application of the medium.

EXAMPLE 4

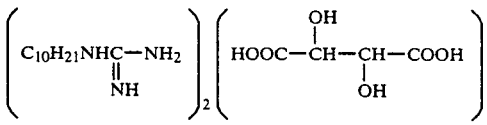

A dispersion was prepared with a disperser which consisted of 3 parts of n-decyl guanidine tartarate of the above general formula, 50 parts of methyl ethyl ketone, and 50 parts of toluene. A mixture of 0.6 part of oxalic acid, 1 part of p-N,N-dimethylaminobenzene diazonium tetrafluoroborate, 0.6 part of 2-hydroxynaphthalene-3-carbonyl-4'-methoxyphenyl ester, and 1.4 parts of 1-hydroxynaphthalene-2-carbonylphenyl ester was dissolved in the dispersion to prepare a sensitizing solution.

Figure 2:
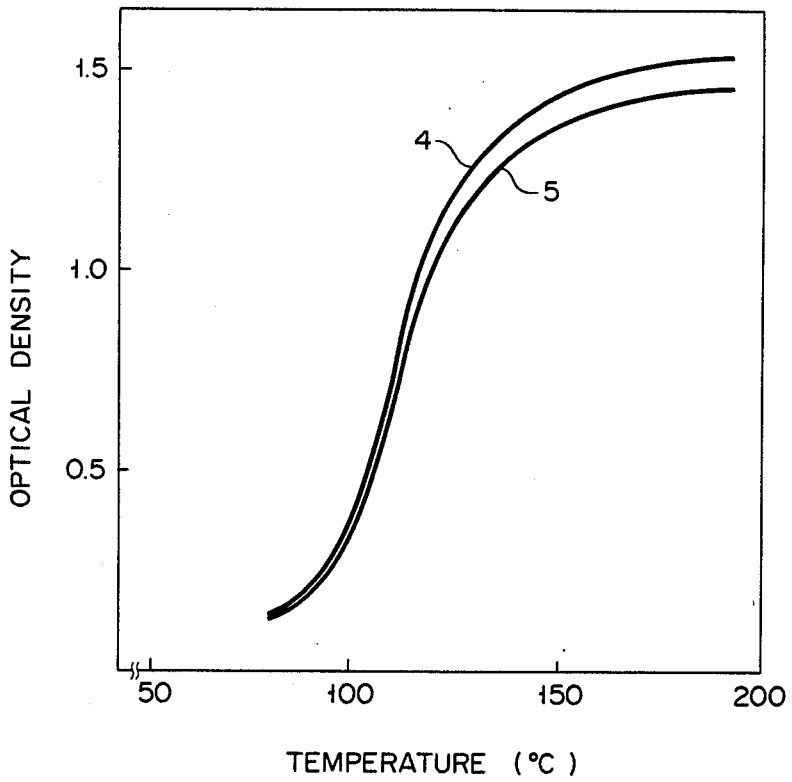
FIG. 2 is a graph showing heat sensitivity curves of diazotype heat development recording paper sheets for recording in black image in Example 4.

The sensitizing solution was coated on a water- and oil-resistant paper sheet with an air knife coater, and the coated layer was dried to prepare a black-type diazotype heat development recording paper sheet. The recording paper sheet was pressed with a heat gradient tester having a heat disc (25×10 mm×10) with a temperature gradient of 50° to 200° C. at a pressure of 2 kg/cm$^2$ for 2 seconds. The recording paper sheet was entirely irradiated with light from a mercury lamp to fix the image, and the hue and optical density at each temperature were measured. A Macbeth densitometer was used for measuring the optical density. The optical density was measured as a black or dark blue color without a filter or through a red filter. FIG. 2 shows the heat sensitivity curves. In FIG. 2, curve 4 represents the optical density at various temperatures measured with a Macbeth densitometer (without filter). Curve 5 represents the optical density at various temperatures measured with a Macbeth densitometer (with a red filter). As may be seen from FIG. 2, the optical density is higher at each temperature when the filter is not used. Thus, a black image may be formed which will not cause changes in the hue of the dye image with changes in heating temperature.

EXAMPLE 5

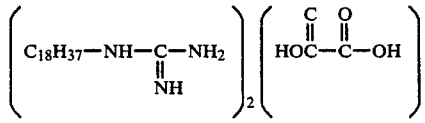

Figure 3:
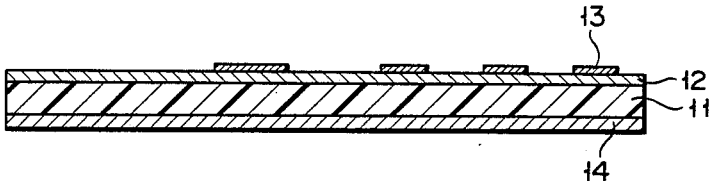
FIG. 3 is a sectional view of an identification card in Example 5 before recording identification information.

A dispersion was prepared with a disperser which consisted of 5 parts of n-octadecyl guanidine oxalate of the above general formula, 50 parts of methyl ethyl ketone, and 50 parts of toluene. A mixture of 1 part of p-N,N-dimethylaminobenzene diazonium tetrafluoroborate, 1 part of 2-hydroxynaphthalene-3-carbonyl-2'-methylanilide, 0.6 part of citric acid, and 20 parts of polystyrene was added to the dispersion to prepare a coating solution. The coating solution was coated with a gravure coater on a polyester sheet having a 200μ thickness and a magnetic recording medium mainly consisting of $\gamma$-$Fe_2O_3$ on its rear surface. The coated layer was dried at 70° C. to form a diazotype heat development recording layer (5μ thickness) on the polyester sheet. After preprinting basic information of an identification card on the recording layer, the medium was punched into a desired shape. The outer appearance of the medium was as shown in FIG. 3. Referring to FIG. 3, reference numeral 14 denotes a magnetic recording layer mainly consisting of $\gamma$-$Fe_2O_3$; 11, a polyester film as a support; 12, a recording medium of the Example; and 13, preprinted characters or patterns.

Figure 4:
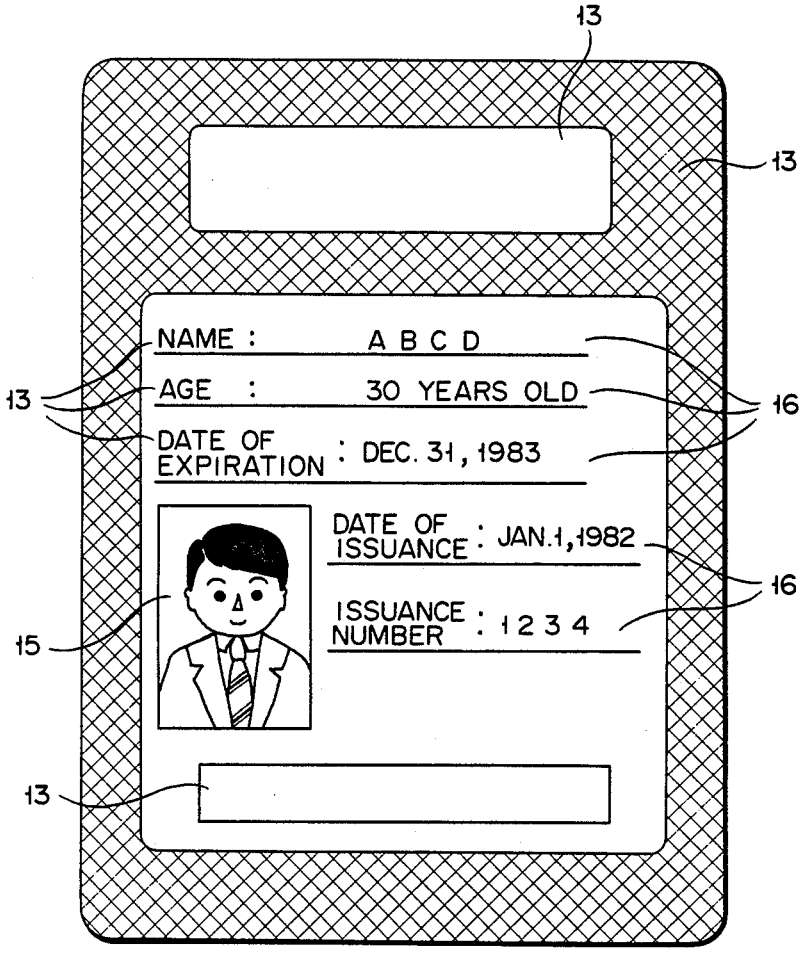
FIG. 4 is a plan view of the identification card in Example 5 after recording identification information.

As shown in FIG. 4, a photograph positive film of continuous gradation with a mask was attached to a photograph information frame 15 on the surface of the polyester film 11. The positive film was exposed with a mercury lamp at a dose of 30 mJ/cm$^2$ to form a positive-positive mode latent image on the frame 15.

The latent image and identification information 16 (e.g., a name, an age, a date of expiration, a date of issuance, and an issuance number) which were stored in a computer were recorded with a thermal head at a thermal head density of 6 lines/mm, a power of 0.45 W and a pulse width of 2.75 ms, as shown in FIG. 7. The entire structure was irradiated with light from a xenon flash device (exposure energy of 600 J) to fix the image to provide an identification card which had clear dark blue images on the polyester film 11. When the identification card was rubbed with gauze dampened with water, an aqueous solution of a neutral detergent, naphtha, or alcohol, the image did not cause discoloration or color deterioration.

EXAMPLE 6

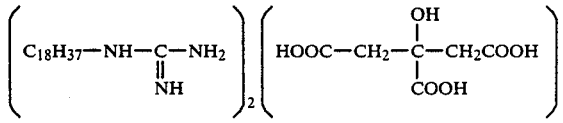

A sensitizing solution consisting of 1 part of 3-methyl-4-pyrrolidonebenzene diazonium tetrafluoroborate, 0.4 part of oxalic acid, 0.2 part of p-toluene sulfonic acid, 4 parts of vinyl chloride-acetate copolymer, 50 parts of THF, and 50 parts of MEK was coated with a knife coater on a white hard vinyl chloride sheet of 730μ thickness. The coated layer was dried at 70° C. A coating solution consisting of 5 parts of di-(octadecyl guanidine) citrate of the above general formula, 1 part of 1-hydroxynaphthalene-2-carbonyl-2'-methoxyanilide, 15 parts of vinyl chloride-acetate copolymer, 40 parts of THF, and 40 parts of MEK was coated with a knife coater. The coated layer was dried at 70° C. to prepare an identification card with a recording layer.

An image of a photograph positive film was exposed on the card by projection exposure (dose: 20 mJ/cm$^2$) to form a latent image of the positive-positive mode on the card. After the image was developed with a heated roller (roller temperature: 200° C.), it was covered with a transparent vinyl chloride cover film having a thickness of 75μ. The image was pressed with a flat hot press at 130° to 140° C. at 5 kg/cm$^2$ for about 20 minutes, and was gradually cooled, and was punched into a desired shape to prepare an identification card with a photograph. The identification card was excellent in water resistance, solvent resistance, and weather resistance. Since the recording layer was covered with a cover film, the card showed over-all excellent durability.

What we claim is:

1. A diazotype heat development recording medium, comprising a support and a recording layer which is formed on said support and which comprises a diazonium compound, a coupler, an acid stabilizer, a thermal developer, and a polymeric binder, wherein the thermal developer is a hydrophobic salt of an organic or inorganic acid having a primary dissociation constant of $2\times10^{-1}$ to $1\times10^{-4}$ with an alkyl substituted guanidine represented by a general formula:

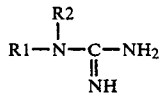

(wherein at least one of R1 and R2 is an alkyl group of $C_8$ to $C_{24}$, and the other of R1 and R2 is a hydrogen atom or an alkyl group of $C_1$ or more).

2. A diazotype heat development recording medium according to claim 1, wherein the diazo compound is a hydrophobic diazo complex.

3. A diazotype heat development recording medium according to claim 1, wherein the coupler is a hydrophobic aromatic hydroxy compound having a sulfamoyl group in a molecule thereof.

4. A diazotype heat development recording medium according to claim 1, wherein the coupler is a hydrophobic aromatic hydroxy compound having a carbamoyl group in a molecule thereof.

5. A diazotype heat development recording medium according to claim 1, wherein the coupler is a hydrophobic aromatic hydroxy compound having a carboxyl group in a molecule thereof.

6. A diazotype heat development recording medium according to claim 1, wherein the polymeric binder is a thermoplastic resin having a glass transition point of 60° to 130° C.

7. A diazotype heat development recording medium according to claim 1, wherein the organic or inorganic acid forming a salt with the guanidine is benezenesulfonic acid, trichloroacetic acid, oxalic acid, glycerophosphoric acid, maleic acid, phosphoric acid, citric acid, malonic acid, tartaric acid, malic acid or lactic acid and the alkyl-substituted guanidine is octyl guanidine, nonyl guanidine, decyl guanidine, undecyl guanidine, lauryl guanidine, tridecyl guanidine, myristyl guanidine, hexadecyl guanidine, octadecyl guanidine, eicosyl guanidine, docosyl guanidine, dioctyl guanidine, dioctadecyl guanidine, N-methyl-N-octadecyl guanidine, N-methyl-N-decyl guanidine, or N,N-didecyl guanidine.

8. A diazotype heat development recording medium according to claim 1, wherein the alkyl-substituent on the guanidine is a straight chain alkyl group.

9. A diazotype heat development recording medium according to claim 1, wherein the thermal developer is di-(n-decyl guanidine) tartarate.

10. A diazotype heat development recording medium according to claim 1, wherein the thermal developer salt is di-(myristyl guanidine)oxalate.

11. A diazotype heat development recording medium according to claim 1, wherein the thermal developer salt is di-(n-octadecyl guanidine)oxalate.

12. A diazotype heat development recording medium according to claim 1, wherein the thermal developer salt is di-(octadecyl guanidine)citrate.

* * * * *